US009624066B2

(12) United States Patent
Dominicis

(10) Patent No.: US 9,624,066 B2
(45) Date of Patent: Apr. 18, 2017

(54) HIGH SPEED WINDING MACHINE WITH ANGULAR ROTARY SPINDLE, AND A METHOD FOR USING THE SAME

(71) Applicant: Philip Patrick Dominicis, Wappingers Fall, NY (US)

(72) Inventor: Philip Patrick Dominicis, Wappingers Fall, NY (US)

( * ) Notice: Subject to any disclaimer, the term of this patent is extended or adjusted under 35 U.S.C. 154(b) by 359 days.

(21) Appl. No.: 14/201,860

(22) Filed: Mar. 8, 2014

(65) Prior Publication Data

US 2014/0263803 A1 Sep. 18, 2014

Related U.S. Application Data

(60) Provisional application No. 61/780,929, filed on Mar. 13, 2013.

(51) Int. Cl.
*B65H 55/04* (2006.01)
*B65H 54/10* (2006.01)

(52) U.S. Cl.
CPC ..... *B65H 55/046* (2013.01); *B65H 54/10* (2013.01); *Y10S 242/901* (2013.01)

(58) Field of Classification Search
CPC ..... B65H 54/10; B65H 54/12; B65H 54/74; B65H 2701/31; B56H 55/04; B56H 55/043; B56H 55/046; Y10S 242/901; B29C 53/56; B29C 53/58; B29C 53/76; B21F 3/02; B21F 3/04; H01F 41/071
USPC ..... 242/901
See application file for complete search history.

(56) References Cited

U.S. PATENT DOCUMENTS 2,231,092 A * 2/1941 Schenck, Sr. ..... B65H 54/66 242/472.4
2,352,737 A * 7/1944 Roosa ..... B65H 54/66 242/472.3
3,112,234 A * 11/1963 Krupp ..... B21D 51/24 156/169
4,406,419 A 9/1983 Kotzur
4,487,373 A * 12/1984 Hatta ..... B65H 54/103 242/480.7
4,523,723 A 6/1985 Kotzur
4,603,545 A * 8/1986 Siebert ..... B65H 54/66 242/472.4
7,249,726 B2 7/2007 Kotzur

* cited by examiner

*Primary Examiner* — William E Dondero
*Assistant Examiner* — Nathaniel Adams
(74) *Attorney, Agent, or Firm* — Aziz M. Ahsan; Ahsan & Associates, PLLC

(57) ABSTRACT

The present invention relates generally to a high speed winding machine with angular rotary spindle, and a method for using the same. The present invention also relates generally to winding machines for winding a cable, and more particularly winding wire at higher speeds without the use, for example, of a reciprocating traverse. The high speed winding machine, primarily comprises of four major systems, namely, a frame assembly, a rotating traverse assembly, an angular spindle assembly, and a spindle drive motor assembly, having a spindle indexing system. A method of winding a wire or cable in a figure-8 pattern upon a mandrel by rotating the mandrel and winding the wire or cable thereon is also disclosed.

8 Claims, 6 Drawing Sheets

HIGH SPEED WINDING MACHINE WITH ANGULAR ROTARY SPINDLE, AND A METHOD FOR USING THE SAME

CROSS-REFERENCE TO RELATED APPLICATION

The instant patent application claims priority to and the benefit of U.S. Provisional Patent Application Ser. No. 61/780,929, filed on Mar. 13, 2013, titled "HIGH SPEED WINDING MACHINE WITH ANGULAR ROTARY SPINDLE, AND A METHOD FOR USING THE SAME," the entire disclosure of which provisional application is incorporated herein by reference.

FIELD OF THE INVENTION

The present invention relates generally to a high speed winding machine with angular rotary spindle, and a method for using the same. The present invention also relates generally to winding machines for winding a cable, and more particularly winding wire at higher speeds without the use, for example, of a reciprocating traverse. The high speed winding machine, primarily comprises of four major systems, namely, a frame assembly, a rotating traverse assembly, an angular spindle assembly, and a spindle drive motor assembly, having a spindle indexing system. A method of winding a wire or cable in a figure-8 pattern upon a mandrel by rotating the mandrel and winding the wire or cable thereon is also disclosed.

BACKGROUND INFORMATION

High speed machines of various speeds, shapes and sizes have been known and used for many years, and for a variety of reasons.

U.S. Pat. No. 4,406,419 (Frank W. Kotzur) discloses a method and apparatus for winding lengths of flexible material, packages produced by such method and apparatus, as well as endforms forming part of the mandrels on which such windings are formed, incorporate a number of winding parameters which are related to one another by a mathematical formula. Specifically, the mathematical relationship ##EQU1## where: A=the guide stroke, Gd=the guide distance from the spindle center brie axis, G=the gain or advance of the wind, Dm=the diameter of the wind or coil, and Ym=the wind or coil width; governs the shape of the walls of the endform and such endforms are used in winding apparatus for producing wound packages of flexible material. From the above equation, the geometrical shape of the wound package can also be determined.

U.S. Pat. No. 4,523,723 (Frank W. Kotzur) discloses a universal winding consisting of a plurality of successive figure-8s spaced radially around a mandrel with the figure-8s being spaced such that the crossovers exist in all but one location to form a payout hole extending from the exterior of the winding into the interior of the axial opening therein in which the speed of the traverse or speed of the mandrel is varied with respect to one another in such a manner that a greater density winding is obtained having a more uniform density, thereby enabling the winding to be compressed more uniformly around the diameter of the coil. A variation in the speed of the traverse or the speed of the spindle with respect to one another can be defined as either a plus or a minus gain and small changes in the gain place the crossovers such that the flexible material is wound more densely.

The invention has particular application to large diameter winds in which relatively large diameter flexible material is wound.

U.S. Pat. No. 7,249,726 (Frank W. Kotzur) discloses an apparatus and process for winding filamentary material in a figure 8 configuration including a rotatable spindle for retaining a mandrel upon which the filamentary material is wound; a traverse mechanism for controlling the laying of wound coils on the mandrel; and controlling the advance of the wound layers on the mandrel in accordance with the rotation of the spindle and the movement of the traverse mechanism to vary the angular displacement of the wound coil so that the number of crossovers of succeeding layers of the wound coils increases as the winding process progresses, thereby increasing the density of the wound coils.

Many types of wire and cable are sold in spool-less packages. The term "package" is a term of art which refers to the coil of wire itself that is wound in a figure 8 to hold itself together. This type of package includes a plurality of windings with each winding crossing itself to form a figure 8. The crossovers of successive windings are angularly displaced and progress around the circumference of the package. The crossovers do not progress a full 360° around the coil so that a radial opening is formed extending to the center of the package. The configuration of the package permits the wire to be extracted or paid out without kinking or twisting. The twist-less payout is due to the manner in which the wire is wound. The twist in each half of the figure 8 winding is offset by the opposite twist of the winding in the other half. Thus, there would be no substantial twisting of the wire as it is paid out.

In prior art winding machines for producing, a figure 8 package includes a spindle which is rotated to wind the wire onto a mandrel or spool, and a guide which is reciprocated back and forth parallel to the axis of the spindle to lay the wire on the spool in a series of figure 8s. The stroke of the traverse is slightly out of phase with the rotation of the spool so that the crossovers progress around the mandrel.

To form the radial opening, the motion of the traverse is alternately advanced and retarded with respect to the spindle for a predetermined number of rotations of the spindle. The number of rotations is selected so that the crossovers never advance a full 360° around the spindle. Thus, a radial hole will be formed at the point where no crossovers are made. The problem with prior art winding machines is that they cannot wind at speeds greater than 1000 feet per minute. Speeds greater than 1000 feet per minute with a conventional reciprocating traverse limit high speed winding, because of the weight of the reciprocating mechanism, and the whipping of the wire between the output of the buffer and the guide tube, which in turn causes the payout hole to collapse on itself, causing an unpayable payout. These factors make unwinding more difficult and may even cause kinking of the wire or cable.

This invention improves on the deficiencies of the prior art and provides an inventive high speed winding machine with angular rotary spindle, and a method for using the same.

PURPOSES AND SUMMARY OF THE INVENTION

The invention is a novel high speed winding machine with angular rotary spindle, and a method for using the same.

Therefore, one purpose of this invention is to provide a cost effective, and durable high speed winding machine with angular rotary spindle, and a method for using the same.

Another purpose of this invention is to provide a high speed winding machine that can wind a wire on a mandrel using an angular rotary spindle mechanism.

Yet another purpose of this invention is to provide a high speed winding machine that can wind a wire or a cable in a figure-8 pattern upon a mandrel by rotating the mandrel and winding the wire or cable thereon.

Therefore, in one aspect this invention comprises a winding, machine for winding a high speed line to form a package, comprising:

(a) a frame assembly;

(b) a spindle motor drive assembly;

(c) a rotating traverse assembly, wherein said rotating traverse assembly is in direct contact with said spindle motor drive assembly via a gearbox drive shaft;

(d) an angular spindle assembly, wherein said angular spindle assembly is in direct contact with said rotating traverse assembly via a spindle drive gear; and (e) a removable spindle, having a mandrel and an endforms, said removable spindle is in direct contact with said angular spindle assembly via a endform spindle shaft.

In another aspect this invention comprises a winding machine for winding a high speed line to form a package, comprising:

(a) a frame assembly, and wherein said frame assembly further comprises of a frame upright to house a spindle motor drive assembly;

(b) said spindle motor drive assembly further composes a 55-degree gearbox to drive a timing chain, and wherein said 55-degree gearbox is driven via a gearbox drive shaft, and wherein said gearbox drive shaft is rotated about its vertical axis via a drive belt assembly, and which drive belt assembly is driven by a servo motor;

(c) a rotating traverse assembly, wherein said rotating traverse assembly is in direct contact with said spindle motor drive assembly via a gearbox drive shaft, and wherein said rotating traverse assembly further comprises a rotating traverse arm, a traverse motor, a traverse shaft, and wherein said rotating traverse arm is rotated about a vertical axis via said traverse shaft, and wherein said traverse shaft is rotating about said vertical axis via a belt drive, assembly, and which belt drive assembly is driven by said traverse motor;

(d) an angular spindle assembly, wherein said angular spindle assembly is in direct contact with said rotating traverse assembly via a spindle drive gear, and wherein said angular spindle assembly further comprises of a spindle shaft bearing housing to house said endform spindle shaft, and wherein said endform spindle shaft is rotated about its longitudinal axis via a timing chain assembly; and (e) a removable, spindle, having a mandrel and an endforms, said removable spindle is in direct contact with said angular spindle assembly via a endform spindle shaft.

In yet another aspect this invention comprises a method of winding a wire in a figure-8 pattern upon a mandrel by rotating said mandrel and winding said wire thereon using an endform spindle shaft driven by a timing chain and a spindle gear drive in a direction along an axis of rotation of said mandrel and using a rotating traverse arm to move said mandrel, in a traverse direction.

BRIEF DESCRIPTION OF THE DRAWINGS

Although the scope of the present invention is much broader than any particular embodiment, a detailed description of the preferred embodiment follows together with drawings. These drawings are for illustration purposes only and are not drawn to scale. Like numbers represent like features and components in the drawings. The invention may best be understood by reference to the ensuing detailed description in conjunction with the drawings in which.

DETAILED DESCRIPTION

Figure 1:
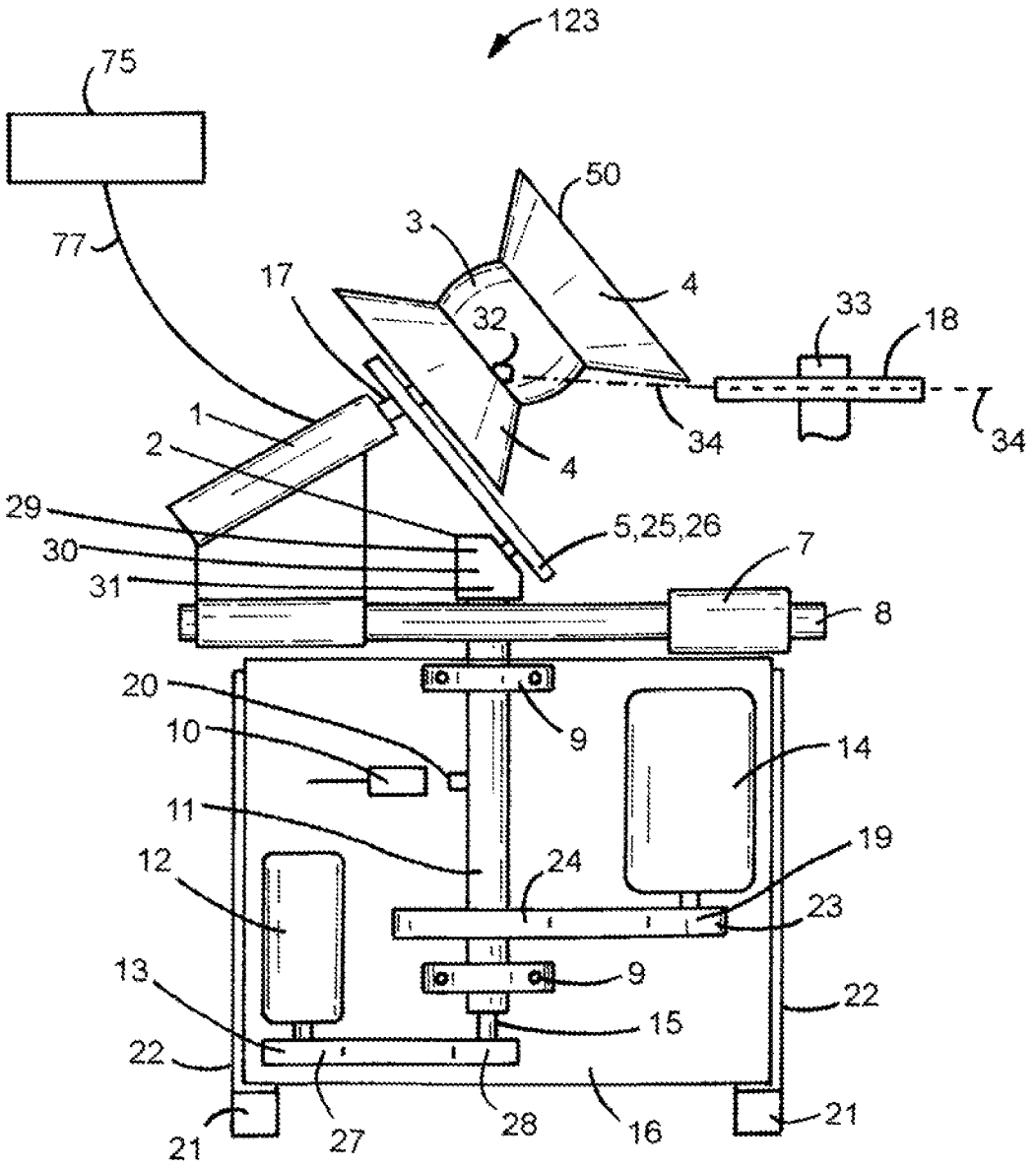
FIG. 1 is a side view of the inventive high speed winding machine according to one embodiment of the present invention.

The embodiments of the present invention are described more fully hereinafter with reference to the accompanying drawings, which form a part hereof, and which show, by way of illustration, specific exemplary embodiments by which the invention may be practiced. This invention may, however, be embodied in many different forms and should not be construed as limited to the embodiments set forth herein. Rather, the disclosed embodiments are provided so that this disclosure will be thorough and complete, and will fully convey the scope of the invention to those skilled in the art.

Throughout the specification and claims, the following terms take the meanings explicitly associated herein, unless the context clearly dictates otherwise. The phrase "in one embodiment" as used herein does not necessarily refer to the same embodiment, though it may. Furthermore, the phrase "in another embodiment" as used herein does not necessarily refer to a different embodiment, although it may. Thus, as described below, various embodiments of the invention may be readily combined, without departing from the scope or spirit of the invention.

The winding machine is designed to wind wire or cable at higher speeds greater than 1000 feet per minute into a package having a radial hole through which the inner end of a wire or cable is paid out. The spindle having a mandrel mounted thereon is mounted on an angle and driven as the rotary traverse rotates in a clockwise direction by a first electric motor. As the rotary traverse completes one rotation the spindle is driven counter clockwise by a gearbox mounted at the center of the rotary traverse with a fixed ratio of 2:1 causing the spindle to rotate two times per revolution of the rotary traverse causing the wound material to form a figure 8 on the mandrel. The spindle then is driven by a second electric motor that allows the mandrel to advance and retard as needed to form the radial hole in the package. As each rotation of the rotary traverse the wire is laid on the spindle in a series of crossover windings in which the wire crosses over itself during each revolution. To produce a figure 8 winding with a single crossover, the rotary traverse should complete 1 revolution for every 2 revolutions of the spindle. For each rotation of the rotary traverse the spindle is advanced causing the crossover point (i.e. the point where the wire crosses itself) progresses around the mandrel. The motion of the spindle is advanced with respect to the rotation of the rotary traverse for a predetermined, number of revolutions. When the spindle is in an advance mode, the crossovers progress in a first direction around the mandrel. After the predetermined number of rotations is completed, the motion of the spindle is retarded with respect to the rotation of the rotary traverse. In the retard mode, the crossovers progress in the opposite direction around the mandrel. The number of rotations is selected so that the crossovers never advance a full 360 degrees around the mandrel. Thus, a radial hole is formed in the package through which the inner end of the wire can be paid out. The motion of the spindle is made by a programmable motion controller. A profile representing the position of the spindle with respect to the position of the rotary traverse is stored in the programmable motion controller's memory. An encoder monitors the position of the rotary traverse and generates a rotation signal that is transmitted to the programmable motion controller. The high speed inputs, monitors the position of the rotary traverse motor and transmits a position feedback signal to the controller. Each time a rotational signal from the rotary traverse is received by the programmable motion controller, the corresponding position of the spindle motor is determined based on the stored profile and a control signal is generated which causes the spindle motor to move to the commanded position. Thus, the programmable motion controller acts like an "electronic cam" to maintain the position of the spindle with respect to the position of the rotary traverse.

FIG. 1 is a side view of the inventive winding machine 123, or the high speed winding machine 123, according to one embodiment of the present invention.

Figure 2:
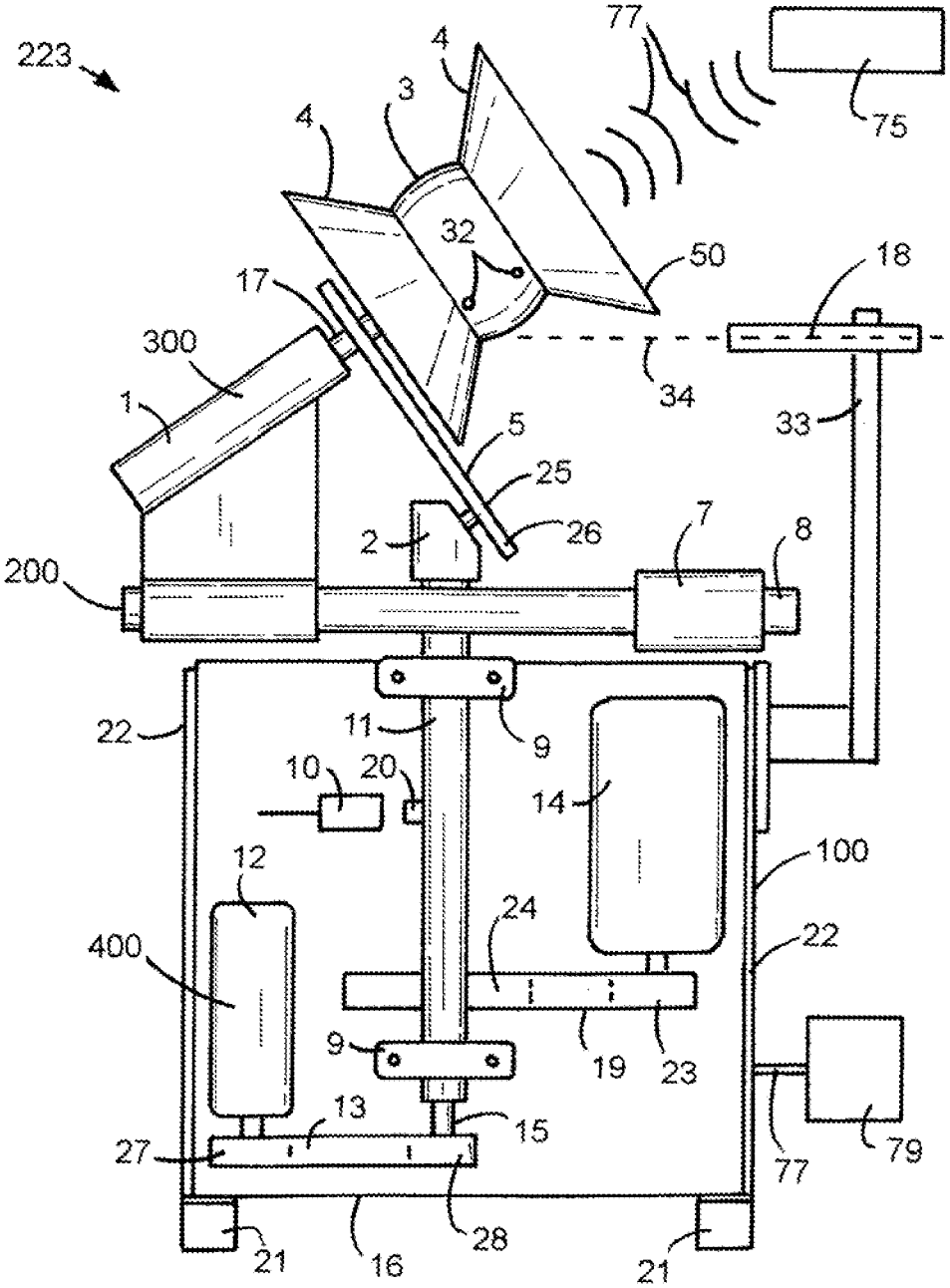
FIG. 2 is a side view of the inventive high speed winding machine according to another embodiment of the present invention.

FIG. 2 is a side view of the inventive high speed winding machine 223, according to another embodiment of the present invention.

Figure 3:
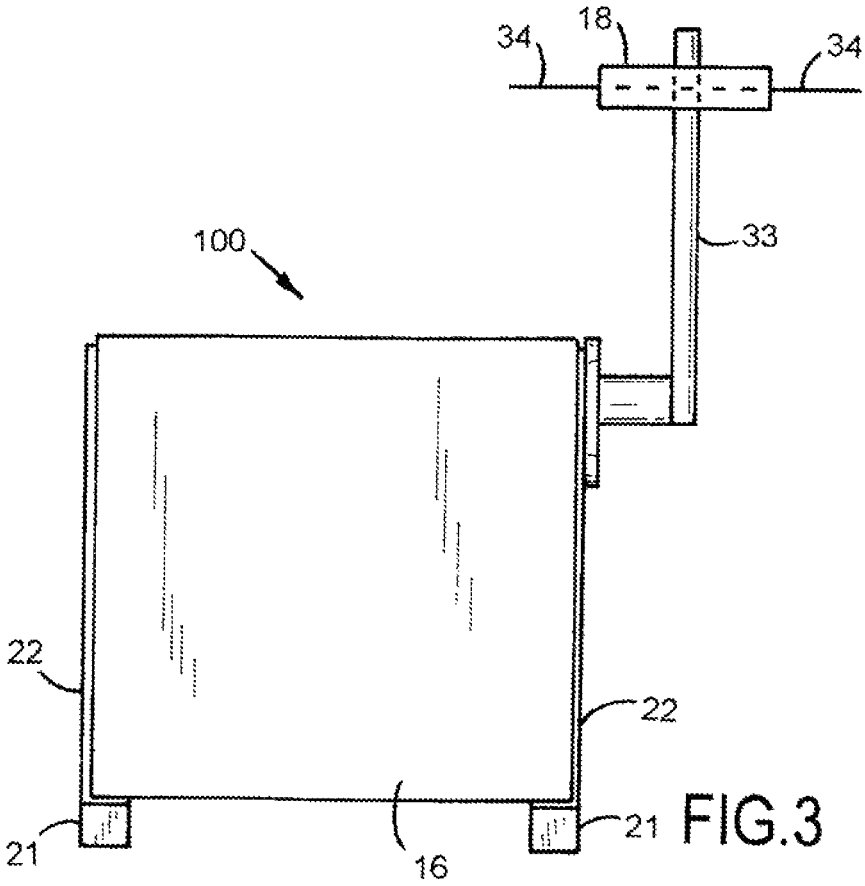
FIG. 3 illustrates a side view of the frame assembly according to one embodiment of the inventive high speed winding machine.

FIG. 3 illustrates a side view of the frame assembly 100, according to one embodiment of the inventive high speed winding machine 123.

Figure 4:
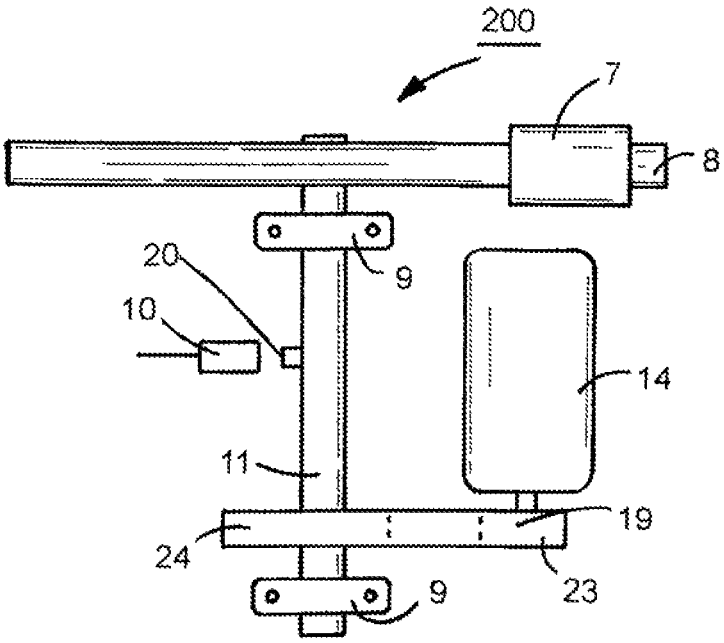
FIG. 4 illustrates a side view of the rotating traverse assembly according to one embodiment of the inventive high speed winding machine.

FIG. 4 illustrates a side view of the rotating traverse assembly 200, according to one embodiment of the inventive high speed winding machine 123.

Figure 5:
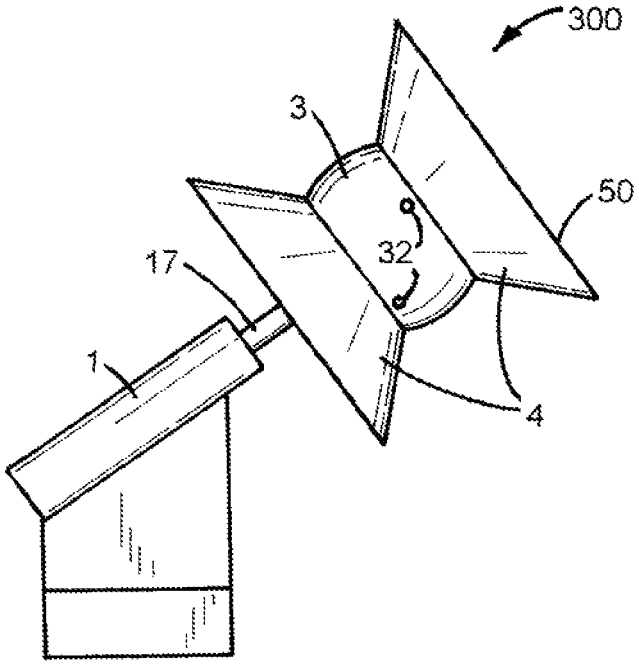
FIG. 5 illustrates a side view of the angular spindle assembly according to one embodiment of the high speed winding machine.

FIG. 5 illustrates a side view of the angular spindle assembly 300, according to one embodiment of the high speed winding machine 123.

Figure 6:
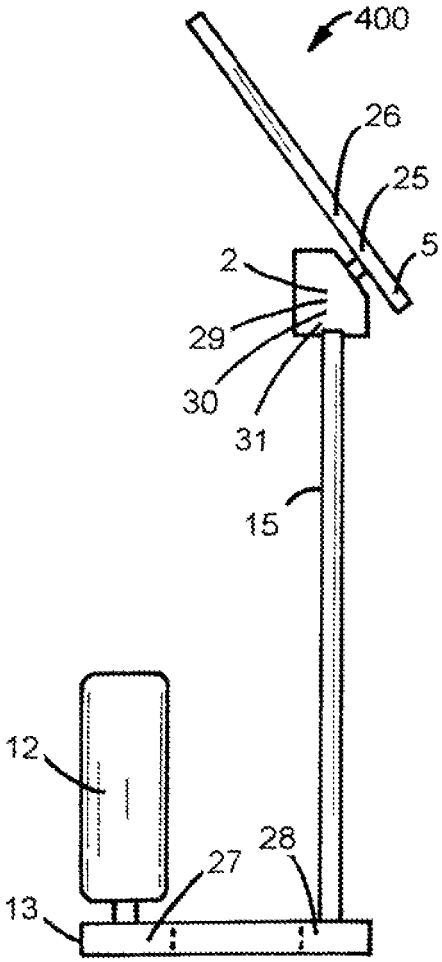
FIG. 6 illustrates a side view of the spindle drive motor assembly according to one embodiment of the high speed winding machine.

FIG. 6 illustrates a side view of the spindle drive motor assembly 400, according to one embodiment of the high speed winding machine 123.

Figure 7:
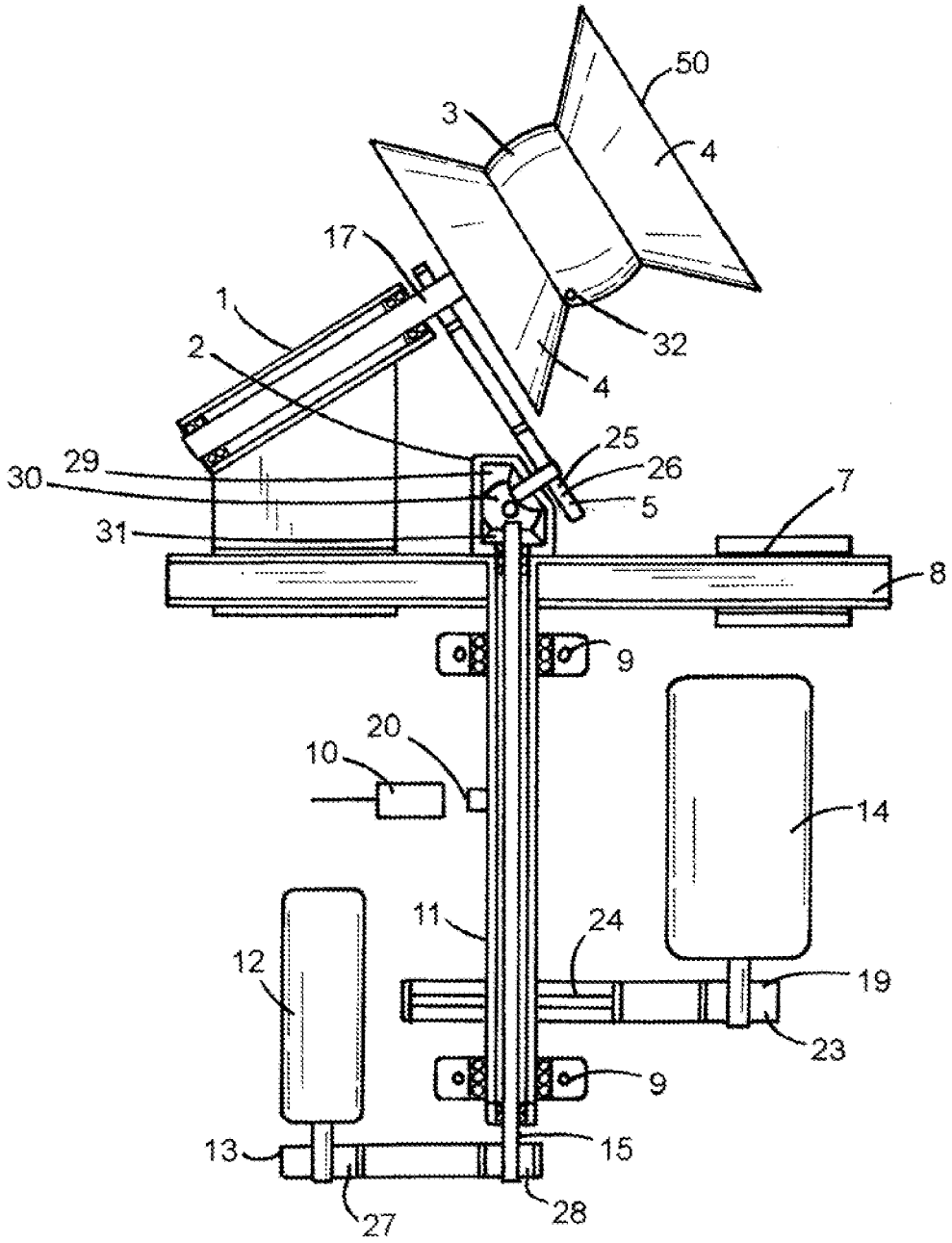
FIG. 7 illustrates a side cut-away view of the inventive high speed winding machine with several supporting structural components removed.

FIG. 7 illustrates a side cut-away view of the inventive high speed winding machine 123, with several supporting structural components removed.

Figure 8A:
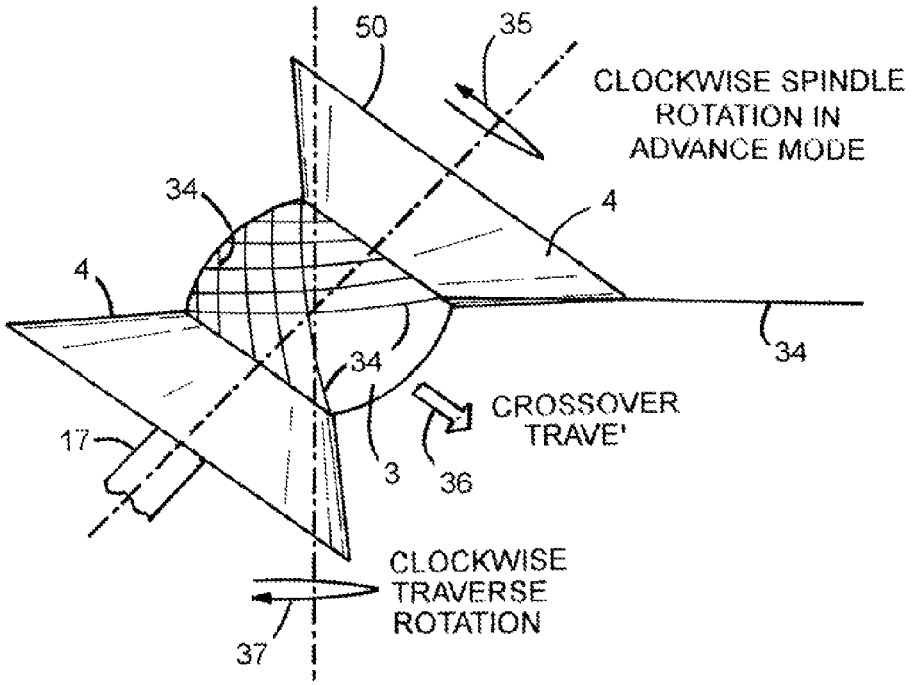
FIG. 8A is a side view of the spindle in advance mode for the high speed winding machine.

FIG. 8A is a side view of the spindle 50, in advance mode for the high speed winding machine 123.

Figure 8B:
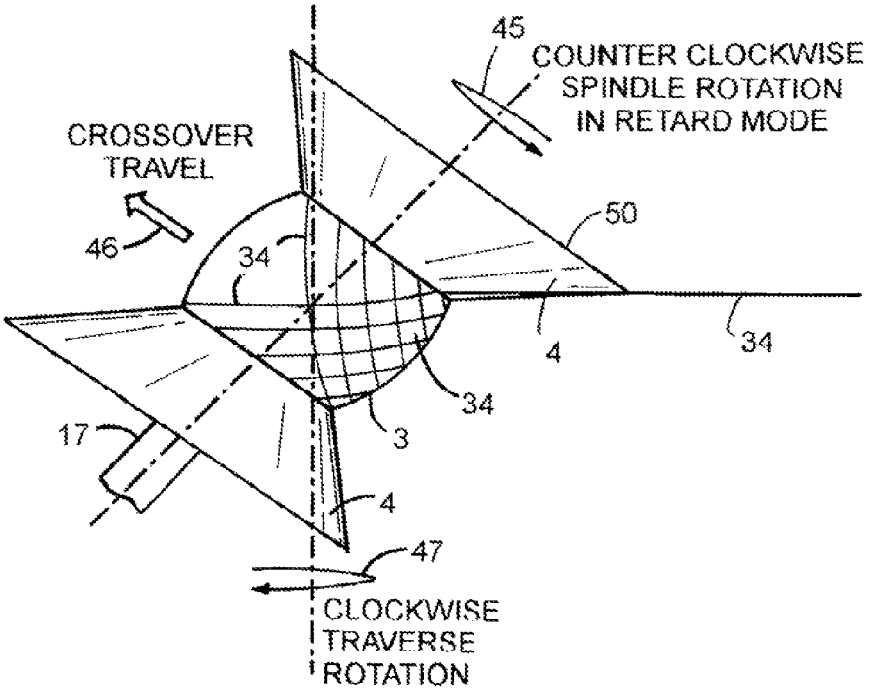
FIG. 8B is a side view of the spindle in retard mode for the high speed winding machine.

FIG. 8B is a side view of the spindle 50, in retard mode for the high speed winding machine 123.

Referring now to the drawings, namely, FIGS. 1 through 8B, the winding machine 123, 223, or the high speed winding machine 123, 223, of the present invention is shown therein and indicated generally by the numeral 123, and the discussions with reference to numeral 123, hereinafter shall include one or both embodiments of the inventive machine, namely, high speed winding machine 123, and/or the high speed winding machine 223. The high speed winding machine 123, primarily includes four major systems—a frame assembly 100, a rotating traverse assembly 200, an angular spindle assembly 300, and a spindle drive motor assembly 400, having a spindle indexing system.

As shown in FIG. 1, and FIG. 2, which are the side views of the inventive winding machine 123, or the high speed winding machine 123, according to an embodiment of the present invention, the high speed winding machine 123, is a standalone machine, which is assembled primarily using, four major systems, namely, the frame assembly 100, the rotating traverse assembly 200, the angular spindle assembly 300, and the spindle drive motor assembly 400, having a spindle indexing system. It should be appreciated that a guide tube 18, having a guide tube support 33, which is securely attached to the frame assembly 100, and the wire or cable 34, to be wound onto the mandrel 3, is guided through the guide tube 18. The spindle 50, has a mandrel 3, and two endforms 4, for containing the wire 34, that would be wound onto the spindle 50. To start the winding process the wire 34, is securely secured inside at least one opening or hole 32, which is preferably on the surface of the mandrel 3. For some applications the high speed winding machine 123, could be electronically connected 77, to an electronic device 75, such as, a computer 75, a programmable motion controller 75, to name a few. The electronic connection 77, could be via a wire 77, as shown in FIG. 1, or it could be a wireless connection 77, as shown in FIG. 2. For some applications the high speed winding machine 123, could have an electronic device 79, securely connected thereto, and wherein the electronic device 79, could be a computer 79, a programmable motion controller 79, to name a few. The electronic device 75, 79, could be used for a variety of purposes, such as, for example, indexing the rotational movement of the mandrel 3, monitoring and/or controlling the other electrical and mechanical components of the high speed winding machine 123, to name a few.

The frame assembly 100, as shown in FIG. 3, comprises of side frames 22, or frame upright 22, and side base frame member 21. The side frames 22, include frame uprights 22, and side base frame member 21. The side frame uprights 22, extend upwardly from the center of side base frame member 21. The side base frame members 21, are generally spaced inwardly from the opposite ends of a mounting plate 16, which provides space for mounting the rotating traverse assembly 200, as shown in FIG. 4, the angular spindle assembly 300, as shown in FIG. 5, and the spindle drive motor assembly 400, as shown in FIG. 6.

Referring now to FIG. 4, the rotating traverse assembly 200, comprises a traverse shaft 11, which is rotatably mounted within a pair of pillow blocks 9. Pillow blocks 9, are mounted to the mounting plate 16, respectively. The traverse shaft 11, is driven by a traverse motor 14, preferably, an electric motor 14. The motor 14, is operatively connected to the traverse shaft 11, by a belt drive assembly 19, 23, 24. The belt drive assembly 19, 23, 24, consists of a motor pulley 23, mounted on the output shaft of the motor 14, and a traverse shaft drive pulley 24, mounted on the traverse shaft 11. A drive belt 19, is entrained around the motor pulley 23, and traverse shaft drive pulley 24, to rotate the traverse shaft 11, when the motor 14, is energized. As the rotating traverse assembly 200, rotates, the pickup switch 10, is activated by a timing tab 20, which is mounted on the traverse shaft 11, and this triggers the spindle indexing system 400, as shown in FIG. 6. Mounted on the top of the traverse shaft 11, is a rotating traverse arm 8. The rotating traverse arm 8, includes an adjustable counter weight 7, and also provides a mounting surface for the angular spindle assembly 300, as shown in FIG. 5.

Referring now to FIG. 5, the angular spindle assembly 300, comprises a spindle shaft 17, which is rotatably mounted within the spindle shaft bearing housing 1. Mounted on the spindle shaft 17, is a spindle shaft drive gear 25, shown in FIG. 1, that is rotated by the spindle motor drive assembly 400, mounted on the front end of the spindle shaft 17, is a spindle or spool 50, having a mandrel 3, and an inner and outer end form 4, and on which the wound material 34, is wound or contained. The angular spindle assembly 300, is mounted to the rotating traverse arm 8, located in the rotating traverse assembly 200, as shown in FIG. 4. Both assemblies 200, 300, rotate together as one assembly.

Referring now to FIG. 6, the spindle motor drive assembly 400, comprises, a motor 12, preferably, a servo motor 12, which is operatively connected to a gearbox drive shaft 15, by a belt drive assembly 13, 27, 28. The belt drive assembly 13, 27, 28, comprises of a motor pulley 27, mounted on the output shaft of the servo motor 12, and a drive shaft drive pulley 28, mounted on the gearbox drive shaft 15. A drive belt 13, is entrained around the motor pulley 27, and drive shaft drive pulley 28, to rotate the gearbox drive shall 15, when the servo motor 12, is energized. Connected to the end of the gearbox drive shaft 15, is a 55 degree gearbox 2; which is operatively connected to the angular spindle assemble 300, shown in FIG. 5, by a gear drive assembly 5, 25, 26. The gear drive assembly 5, 25, 26, consists of a gearbox gear 26, mounted on the output shaft of the gearbox 2, and a spindle shaft drive gear 25, mounted on the spindle shaft 17. A timing chain 5, is entrained around the gearbox gear 28, and spindle shaft drive pulley 24, to rotate the spindle shaft 17, when the servo motor 12, is energized. The gearbox 2, further comprises bevel gears 29, 30, 31, as more fully explained in FIG. 7.

Referring now to FIG. 7, which illustrates a side cut-away view of the inventive winding machine 123, with several supporting structural components removed, shows a 55 degree gearbox 2, having an upper or driven bevel gear 29, that is in rotary contact with a lower or drive bevel gear 31, via an intermediate or idler bevel gear 30. The lower bevel gear 31, is driven via a traverse drive shaft 11, that is attached to the drive shaft pulley 28. The upper bevel gear 29, drives the spindle shaft 17, via the spindle shaft drive assembly, 5, 25, 26. As stated earlier that the traverse shaft 11, is driven via the drive shaft assembly 13, 27, 28, that are securely attached to a servo-motor 12.

Referring now to FIG. 8A, which is a side view of the spindle or spool 50, in advance mode 36, and FIG. 8B, which is a side view of the spindle or spool 50, in retard mode 46. FIG. 8A, shows the rotary traverse and spindle assembly rotating in the clockwise direction 35, in the advance mode. As the rotary traverse and spindle assembly rotates, the spindle 50, and mandrel 3, automatically rotates in the clockwise spindle rotation in advance mode 35, and clockwise traverse rotation 37, direction at a fixed ratio of 1:2 which is achieved through the gear box 26. This gear ratio of 1:2 will cause the wire or cable 34, to form an X pattern on the mandrel 3, every time the rotary traverse and spindle assembly complete one rotation the spindle 50, will rotate two times, causing the wire 34, to form the X pattern on the mandrel 3, in the same place causing the crossovers to stack on top of each other. To prevent this from happening the spindle 50, is indexed by the servo motor 12, in the advanced clockwise direction 35, 37, causing the crossovers to travel counterclockwise around the mandrel 3, until the desired number of crossovers to the hole 32, are achieved. When this happens the servo motor 12, changes direction to index the spindle 50, in the retard mode 46, causing the spindle 50, to rotate in the counterclockwise spindle rotation in retard mode 45, and clockwise traverse rotation 47, direction causing the crossovers to travel in the clockwise direction to form the next layer of the wind 34, while the rotary traverse and spindle assembly are still rotating in the clockwise direction 35, until the desired number of crossovers to the hold are achieved, as shown in FIG. 8B. The advance mode 36, and the retard mode 46, alternate per layer throughout the wind 14, until the desired footage of wire 34, is achieved.

The material for the spindle or spool 50, is preferably selected from a group comprising, metal, plastic, steel, stainless steel, aluminum, copper, wood, composite material, and combinations thereof, to name a few.

The material for the wire or cable 34, is preferably selected from a group comprising: metal, steel, aluminum, copper, composite material, and combinations thereof, to name a few.

The electronic device 75, 79, could be selected from a group comprising, a computer, a tablet, a smart phone, a laptop, a programmable motion controller, and combinations thereof, to name a few.

One Method of Machine Operation

One method of the inventive machine operation is illustrated in FIG. 8A, and FIG. 8B. After the wire 34, to be wound is securely attached to the hole or opening 32, of the mandrel 3, of the spindle 50, which is by inserting the end of the wire into the hole 32, which is preferably on the mandrel 3, the operator can enter the wire size, hole size, and the footage into the program on a computer, and then press the start button. The start button could be located on the high speed winding machine 123, or it could be located on an electronic device 75, 79, such as, a computer 75, 79, a programmable motion controller 75, 79, to name a few.

Preferably, bevel gear 31, is held stationary by the servo motor 12. Thus when the rotating traverse assembly 8, is rotated by motor 14, and belt and pulleys 19, 23, 24, bevel gears 30 and 29 in the gearbox 2, are also rotated since they are carried around by the rotation of the rotating traverse assembly 8, on which it is mounted, while bevel gear 31, is held stationary, rotation of the timing belt and pulleys 5, 25, 26, acts through the gearbox bevel gears 29, 30, 31, to drive the endform spindle shaft 17. The timing belt and pulleys 5, 25, 26, are so chosen that the endform spindle shaft 17, is driven twice the speed of the rotating traverse assembly. Such operation would, if uninterrupted, form successive layers on the mandrel 3, each composed of a plurality of figure eight coils, the crossovers of successive coils stacking on top of each other instead of progressing, angularly around the package.

However, the above-stated action is interrupted in the present machine. At each successive rotation of the rotating traverse assembly 8, will occupy a different angular position around the axis of the mandrel 3, as it passes switch 10, causing, the servo motor 12, to index a predetermined number of degrees in the clockwise direction controlled by a PLC, causing the timing belt and pulleys 13, 27, 28, driveshaft 15, gearbox 2, mandrel 3 and rotating traverse assembly 8, to be out of phase. For example, the mandrel 3, may rotate 61 times for each 30 revolutions of the rotating traverse assembly 8, (advanced wind) until the desired number of coils to the hole is achieved. Then as the rotating traverse assembly 8, passes switch 10, causing the servo motor to index in the counterclockwise direction, causing the mandrel 3, to rotate out of phase in the retard mode 46. For example, the mandrel 3, may rotate 59 times for each 30 revolutions of the rotating traverse assembly 8, (retard wind) until the desired number of coils to the hole 32, is achieved. The advance mode 36, and the retard mode 46, alternate per layer throughout the wind until the desired footage of wire or cable 34, is achieved.

Anything less than 360 degrees of indexing in the advance and retard of the mandrel per layer will cause the hole to form in the package. For example, after entering the wire or cable information, such as, for example, diameter, hole size, footage, and other related information into the program, the PLC (Programmable Logic Controller or Programmable Controller) determines how many crossovers (coils) will fit on the mandrel 3, and each layer after until the set footage is reached, if the PLC is programmed to index the mandrel 300 degrees per layer the hole would be small, however, if 250 degrees were programmed per layer then the hole would be larger.

It should be appreciated that in the winding machines art the endforms 4, may be fixed to the mandrel 3, or alternatively one or both of endforms 4, may be removably attached to the mandrel 3. Both configurations are known to a person skilled in the art or is familiar with the winding art to which the present invention pertains. Furthermore, the exterior surface of the mandrel 3, may be spherical, elliptical, or any other generally curved surface, which preferably slopes downwardly from the center of the mandrel 3, to the endforms 4. Thus it is to be understood that the configuration of the mandrel 3, and the endforms 4, shown in the Figures are only illustrative for the purposes of describing the invention, and the invention is not to be construed as being limited to the mandrel 3, and endform 4, configuration as shown in the Figures. Moreover, the invention described and claimed herein has application to expandable type mandrels 3, as well as compressible mandrels 3, and endforms 4, known to the winding art.

It should also be appreciated that for some applications a winding in accordance with the invention is formed by winding figure-8s spaced radially around the mandrel 3, or the layer of material 34, beneath the one layer being wound. The figure-8s are spaced such that the crossovers exist in all but one location and the absence of crossovers generates a payout hole through which the inner end of the winding 34, may be withdrawn such that the winding 34, is paid out from the inside out through the payout hole.

The tool used in the preset invention, namely, the high speed winding machine 123, may be implemented using one or more computers executing software instructions. According to one embodiment of the present invention, the high speed winding machine 123, may communicate with server and client computer systems that transmit and receive data over a computer network or a fiber or copper-based telecommunications network 77. The steps of accessing, downloading, and manipulating the data, as well as other aspects of the present invention are implemented by central processing units (CPU) in the server and client computers executing sequences of instructions stored in a memory. The memory may be a random access memory (RAM), read-only memory (ROM), a persistent store, such as a mass storage device, or any combination of these devices. Execution of the sequences of instructions causes the CPU to perform steps according to embodiments of the present invention.

The instructions may be loaded into the memory of the server or client computers from a storage device or from one or more other computer systems over a network connection. For example, a client computer may transmit a sequence of instructions to the server computer in response to a message transmitted to the client over a network by the server. As the server receives the instructions over the network connection, it stores the instructions in memory. The server may store the instructions for later execution, or it may execute the instructions as they arrive over the network connection. In some cases, the CPU may directly support the downloaded instructions. In other cases, the instructions may not be directly executable by the CPU, and may instead be executed by an interpreter that interprets the instructions. In other embodiments, hardwired circuitry may be used in place of, or in combination with, software instructions to implement the present invention. Thus tools used in the present invention are not limited to any specific combination of hardware circuitry and software, nor to any particular source for the instructions executed by the server or client computers. In some instances, the client and server functionality may be implemented on a single computer platform.

Thus, the present invention is not limited to the embodiments described herein and the constituent elements of the invention can be modified in various manners without departing from the spirit and scope of the invention. Various aspects of the invention can also be extracted from any appropriate combination of a plurality of constituent elements disclosed in the embodiments. Some constituent elements may be deleted in all of the constituent elements disclosed in the embodiments. The constituent elements described in different embodiments may be combined arbitrarily.

Still further, while certain embodiments of the inventions have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions.

While the present invention has been particularly described in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

What is claimed is:

1. A winding machine for winding a high speed line to form a package, comprising:

(a) a frame assembly, and wherein said frame assembly further comprises of a frame upright to house a spindle motor drive assembly, (b) said spindle motor drive assembly further comprises a 55-degree gearbox to drive a timing chain, and wherein said 55-degree gearbox is driven via a gearbox drive shaft, and wherein said gearbox drive shaft is rotated about its vertical axis via a drive belt assembly, and which drive belt assembly is driven by at least one servo motor;

(c) a rotating traverse assembly, wherein said rotating traverse assembly is in direct contact with said spindle motor drive assembly via said gearbox drive shaft, and wherein said rotating traverse assembly further comprises a rotating traverse arm, a traverse motor, a traverse shaft, and wherein said rotating traverse arm is rotated about a vertical axis via said traverse shaft, and wherein said traverse shaft is rotating about said vertical axis via a belt drive assembly, and which belt drive assembly is driven by said traverse motor;

(d) an angular spindle assembly, wherein said angular spindle assembly is in direct contact with said rotating traverse assembly, and wherein said angular spindle assembly further comprises of a spindle shaft bearing housing to house said endform spindle shaft, and wherein said endform spindle shaft is rotated about its longitudinal axis via a timing chain assembly; and (e) a removable spindle, having a mandrel and endforms at each end of said mandrel, said removable spindle is in direct contact with said angular spindle assembly via said endform spindle shaft.

2. The winding machine for winding a high speed line to form a package of claim 1, wherein said at least one servo motor is used for indexing said removable spindle.

3. The winding machine for winding a high speed line to form a package of claim 1, wherein said removable spindle is rotated such that a line in a generally figure-8 pattern is formed about said mandrel with a crossover point as each winding progresses around said mandrel.

4. The winding machine for winding a high speed line to form a package of claim 1, wherein said spindle motor drive assembly is fixedly contained inside said frame assembly.

5. The winding machine for winding a high speed line to form a package of claim 1, wherein a guide tube is secured to said frame assembly via at least one guide tube support.

6. The winding machine for winding a high speed line to form a package of claim 1, wherein an electronic controller is in electrical contact with said angular spindle assembly to monitor and control movements of said removable spindle.

7. The winding machine for winding a high speed line to form a package of claim 1, wherein said removable spindle is rotated about said endform spindle shaft using at least one timing chain, and wherein said timing chain is driven via said spindle drive gear.

8. The winding machine for winding a high speed line to form a package of claim 1, wherein an electronic device is in operational contact with said angular spindle assembly and said rotating traverse assembly to monitor and control the movements of said removable spindle.

* * * * *